US008276351B1

(12) United States Patent
Henkin

(10) Patent No.: US 8,276,351 B1
(45) Date of Patent: Oct. 2, 2012

(54) WEIGHT TRAINING EXERCISE APPARATUS AND METHODS OF MANUFACTURING A WEIGHT BAG FORMING A PART OF A WEIGHT TRAINING EXERCISE APPARATUS

(76) Inventor: Joshua A. Henkin, Scottsdale, AZ (US)

( * ) Notice: Subject to any disclaimer, the term of this patent is extended or adjusted under 35 U.S.C. 154(b) by 394 days.

(21) Appl. No.: 12/728,610

(22) Filed: Mar. 22, 2010

(51) Int. Cl.
*B65B 4/04* (2006.01)

(52) U.S. Cl. ..... 53/469; 53/470; 53/502; 482/89

(58) Field of Classification Search ..... 53/469, 53/470, 472, 476, 479, 502, 570, 284.7; 482/89, 482/86, 83, 90
See application file for complete search history.

(56) References Cited

U.S. PATENT DOCUMENTS 4,103,889 A * 8/1978 Lobur ..... 482/86
4,208,048 A * 6/1980 Winterbottom ..... 482/84
5,804,020 A * 9/1998 Akao et al. ..... 156/251
5,857,948 A * 1/1999 Barnett ..... 482/140
6,035,606 A * 3/2000 Bussey et al. ..... 53/138.4
6,244,993 B1 * 6/2001 Dunn ..... 482/83
7,678,028 B1 * 3/2010 Gore ..... 482/89
7,877,966 B2 * 2/2011 Knoke et al. ..... 53/469
2002/0010057 A1 * 1/2002 Bouvier ..... 482/86
2012/0058863 A1 * 3/2012 Brizard et al. ..... 482/93

* cited by examiner

*Primary Examiner* — Sameh H. Tawfik
(74) *Attorney, Agent, or Firm* — Parsons & Goltry; Michael W. Goltry; Robert A. Parsons

(57) ABSTRACT

A weight training exercise apparatus incorporates a handled bag to receive a weight bag containing a mass of granular material having a weight. The weight bag is formed with a sheet of flexible, pliant material, and has a bag chamber formed by and between a closed end and an opposed mouth and opposed closed sides formed by opposed hems formed in the sheet extending between the closed end of the weight bag and the mouth. The hems extend into the bag chamber, which is filled with the mass of granular material. The mouth is formed with primary and second seals to close the mouth to prevent granular material from spilling from the mouth.

3 Claims, 11 Drawing Sheets

50
81
85
84
80
54
60
52A
55
56
52
57

50
81
85
84
80
54
92
60
52B
52
57

50
84
85
80
53
82
94
70
52B
52
57

50
84
85
80
53
82
70
90
100
52B
52
57

120
112
82
81
80
53
121
130
54
111
52
60
51A
70
52B
51B
126
51
52A
57

85
123
16
14
84
122
51A
60
51

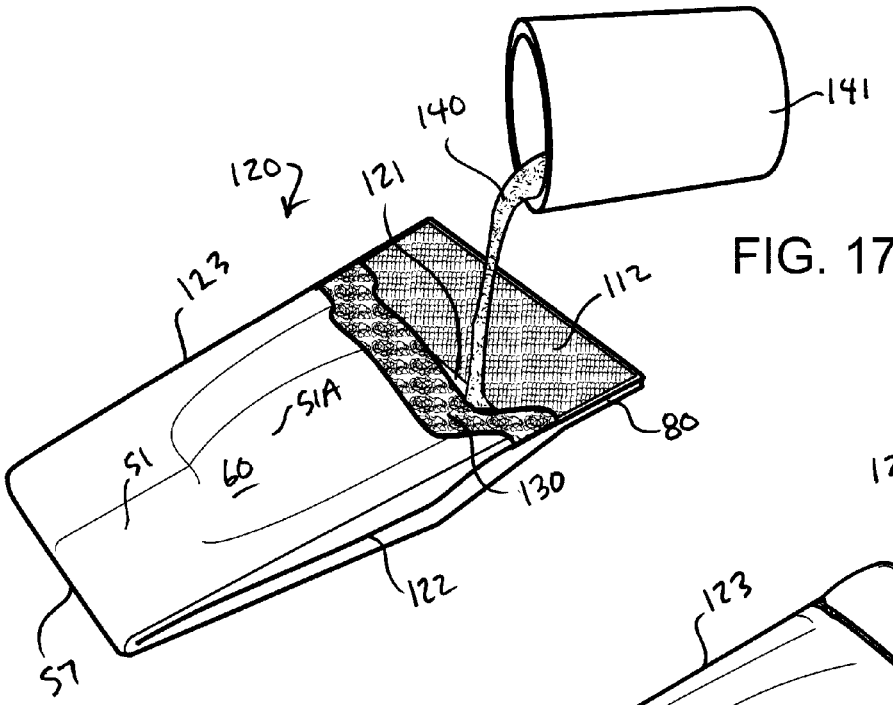
FIG. 17
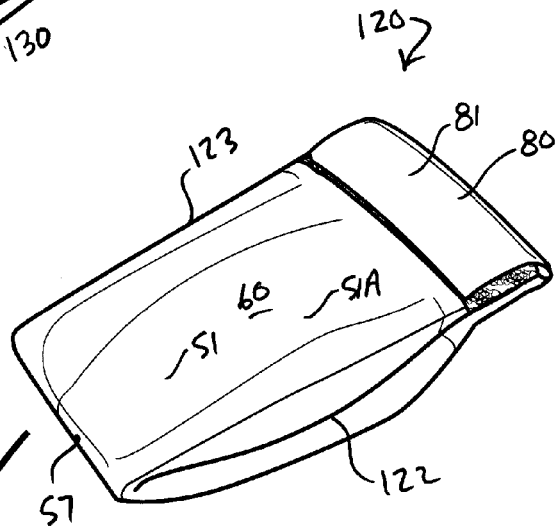
FIG. 22
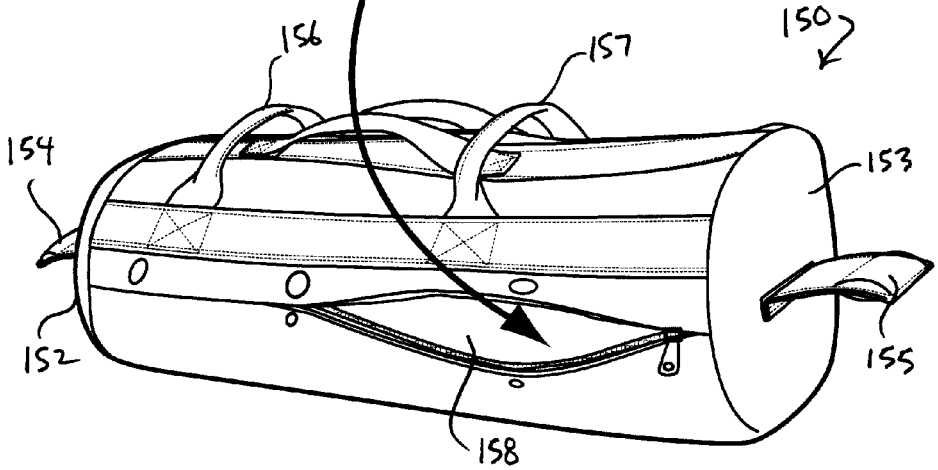

WEIGHT TRAINING EXERCISE APPARATUS AND METHODS OF MANUFACTURING A WEIGHT BAG FORMING A PART OF A WEIGHT TRAINING EXERCISE APPARATUS

FIELD OF THE INVENTION

The present invention relates to exercise equipment.

BACKGROUND OF THE INVENTION

Weight training is a system of physical conditioning using such weights as barbells and dumbbells and other devices, including weight machines. Weight training is used both for physical rehabilitation and for athletic and general conditioning. Athletes use it form to improve their performance by increasing strength and endurance. It is used extensively by track-and-field athletes, swimmers, football players, and soccer players, as well as by other sportsmen for whom basic strength is important to their training program.

Weight training also is used to promote general physical fitness and conditioning and to develop the musculature for physique and body-building contests. In rehabilitation after an illness, injury, or long confinement, weight training is commonly referred to as progressive resistance exercise, and it is usually undertaken at the direction of a physician.

Given the importance and popularity of weight training, the art is replete with a wide variety of free weight systems, weight machines, and the like designed to provide athletes and sportsman with means to accomplish efficient and focused training goals. Although skilled artisans have devoted considerable time and effort toward the development of new and improved weight training systems, needed is yet another to provide athletes and sportsman with a unique form of weight training apparatus that is specifically designed to allow athletes and sportsmen to target muscles groups not commonly targeted in conventional weight training.

SUMMARY OF THE INVENTION

According to the principle of the invention, a method of manufacturing a bag for receiving, holding, and containing a mass of granular material includes providing an elongate, substantially rectangular sheet of flexible, pliant material having opposed first and second major faces, opposed, substantially parallel first and second end marginal edges, opposed, substantially parallel first and second side marginal edges extending between the first and second end marginal edges, and an intermediate section between the opposed first and second end marginal edges extending across the sheet from the first side marginal edge to the second side marginal edge defining opposed, substantially coextensive first and second sections of the sheet on either side of the intermediate section. The sheet has a width extending between the first and second side marginal edges, and a length extending between the first and second end marginal edges. The first section of the sheet extends from the intermediate section to the first end marginal edge, and the first section includes a first length of the first side marginal edge extending from the intermediate section to the first end marginal edge, a first length of the second side marginal edge extending from the intermediate section to the first end marginal edge, a first portion of the first major face extending between the intermediate section and the first end marginal edge and between the first lengths of the first and second side marginal edges, respectively, and a first portion of the second major face extending between the intermediate section and the first end marginal edge and between the first lengths of the first and second side marginal edges, respectively. The second section of the sheet extends from the intermediate section to the second end marginal edge, and the second section includes a second length of the first side marginal edge extending from the intermediate section to the second end marginal edge, a second length of the second side marginal edge extending from the intermediate section to the second end marginal edge, a second portion of the first major face extending between the intermediate section and the second end marginal edge and between the second lengths of the first and second side marginal edges, respectively, and a second portion of the second major face extending between the intermediate section and the second end marginal edge and between the second lengths of the first and second side marginal edges, respectively. A flap is attached to and projects outward from the second end marginal edge of the second section of the sheet. The flap has a first surface contiguous with the first major face, an opposed second surface contiguous with the second major face, and the flap extends along substantially the entire width of the sheet from a first extremity of the flap located inboard of the first end marginal edge and a second extremity of the flap located inboard of the second end marginal edge.

The method next includes forming an unfinished bag by folding the sheet at the intermediate section to form a fold in the intermediate section and applying the first section of the sheet over and atop the second section of the sheet applying the first portion of the first major face over the second portion of the first major face, applying the first length of the first side marginal edge of the first section atop and along the second length of the first side marginal edge of the second section, applying the first length of the second side marginal edge of the first section atop and along the second length of the second side marginal edge of the second section, and applying the first end marginal edge of the sheet atop and along the second end marginal edge of the sheet such that the flap projects outward and is exposed with respect to the first and second end marginal edges. The method next includes forming first and second hems in the sheet. Forming the first hem in the sheet includes folding back the first end second lengths of the first side marginal edge of the first and second sections of the sheet onto the second major face of the sheet forming a first folded marginal extremity extending from the intermediate section of the sheet to the first and second end marginal edges, folding back the first folded marginal extremity onto the second major face of the sheet forming a first double folded marginal extremity extending from the intermediate section of the sheet to the first and second end marginal edges, and sewing down the first double folded marginal extremity from the intermediate section of the sheet to the first and second end marginal edges. Forming the second hem in the sheet includes folding back the first and second lengths of the second side marginal edge of the first and second sections of the sheet onto the second major face of the sheet forming a second folded marginal extremity extending from the intermediate section of the sheet to the first and second end marginal edges, folding back the second folded marginal extremity onto the second major face of the sheet forming a second double folded marginal extremity extending from the intermediate section of the sheet to the first and second end marginal edges, and sewing down the second double folded marginal extremity from the intermediate section of the sheet to the first and second end marginal edges thereby forming an unfinished bag. At this stage, the second major face of the sheet forms is outer surface of the unfinished bag and the first major face of the sheet is the inner surface of the unfinished bag. The method also includes applying a hook and loop fastening system to the sheet including a first element thereof applied across the second major face of the first section of the sheet at the first end marginal edge extending from the first hem to the second hem, and a complemental element thereof applied across the second surface of the flap and the second major face of the second section of the sheet at the second end marginal edge extending from the first hem to the second hem.

Further to the present method is the step of turning the unfinished bag inside out to form a finished bag having an outer surface formed by the first major face of the sheet, an inner surface formed by the second major face of the sheet, a closed end formed by the intermediate section and an opposed mouth formed by and between the first and second end marginal edges of the first and second sections extending between the opposed first and second hems, opposed closed sides formed by the first and second hems extending between the closed end of the bag at the intermediate section and the mouth of the bag, and a bag chamber formed by and between the closed end formed by the intermediate section, the opposed closed sides, the mouth, and the first portion of the second major face confronting the second portion of the second major face, in which the first and second hems are inverted in the finished bag extending into the bag chamber, the flap extends across the mouth from the first extremity of the flap at the first hem to the second extremity of the flap at the second hem, and the first element of the hook and loop fastening system applied across the second major face of the first section of the sheet at the first end marginal edge extends from the first hem to the second hem and opposes and confronts the complemental element of the hook and loop fastening system applied across the second major face of the second section of the sheet at the second end marginal edge, which extends from the first hem to the second hem. The step of applying a hook and loop fastening system to the sheet further includes applying a second element across the first major face of the first section of the sheet at the first end marginal edge extending from the first hem to the second hem. The first and second elements of the hook and loop fastening system are each one of a hook portion and a loop portion of the hook and loop fastening system, and the complemental element of the hook and loop fastening system is the other of the hook portion and the loop portion of the hook and loop fastening system.

Application of weight to the bag to form a weighted bag useful for resistance training purposes consists of providing a mass of granular material having a weight, applying the mass of granular material to the bag chamber through the mouth, and sealing the mouth by applying the first element of the hook and loop fastening system applied across the second major face of the first section of the sheet at the first end marginal edge against the complemental element of the hook and loop fastening system applied across the second major face of the second section of the sheet at the second end marginal edge forming primary seal of the mouth, folding the flap over the mouth and the second element of the hook and loop fastening system applied to the first portion of the first surface of the first section of the sheet registering the complemental element of the hook and loop fastening system applied across the second surface of the flap with the second element of the hook and loop fastening system, and applying the complemental elemental element of the hook and loop fastening system against the second element of the hook and loop fastening system securing the flap forming a secondary seal of the mouth. After forming the weighted bag, the method next includes providing a handled bag, and applying the imbalanced weighted bag component to the handled bag to form a weighted exercise apparatus this may be taken up by hand at the handles and lifted by the user for resistance training purposes. In a particular embodiment, the method still further includes coupling the handled bag to a weight by providing an elongate, pliant strapping and coupling the strapping between the weight and the handled bag.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings:

FIG. 17 is a perspective view of the finished bag of FIGS. 13-15 shown as it would appear being filled with a mass of granular material;

FIG. 22 is a perspective view of the embodiment of FIG. 19 shown as it would being applied into a handled bag to form a weighted handled bag for use in resistance training;

DETAILED DESCRIPTION

Figure 1:
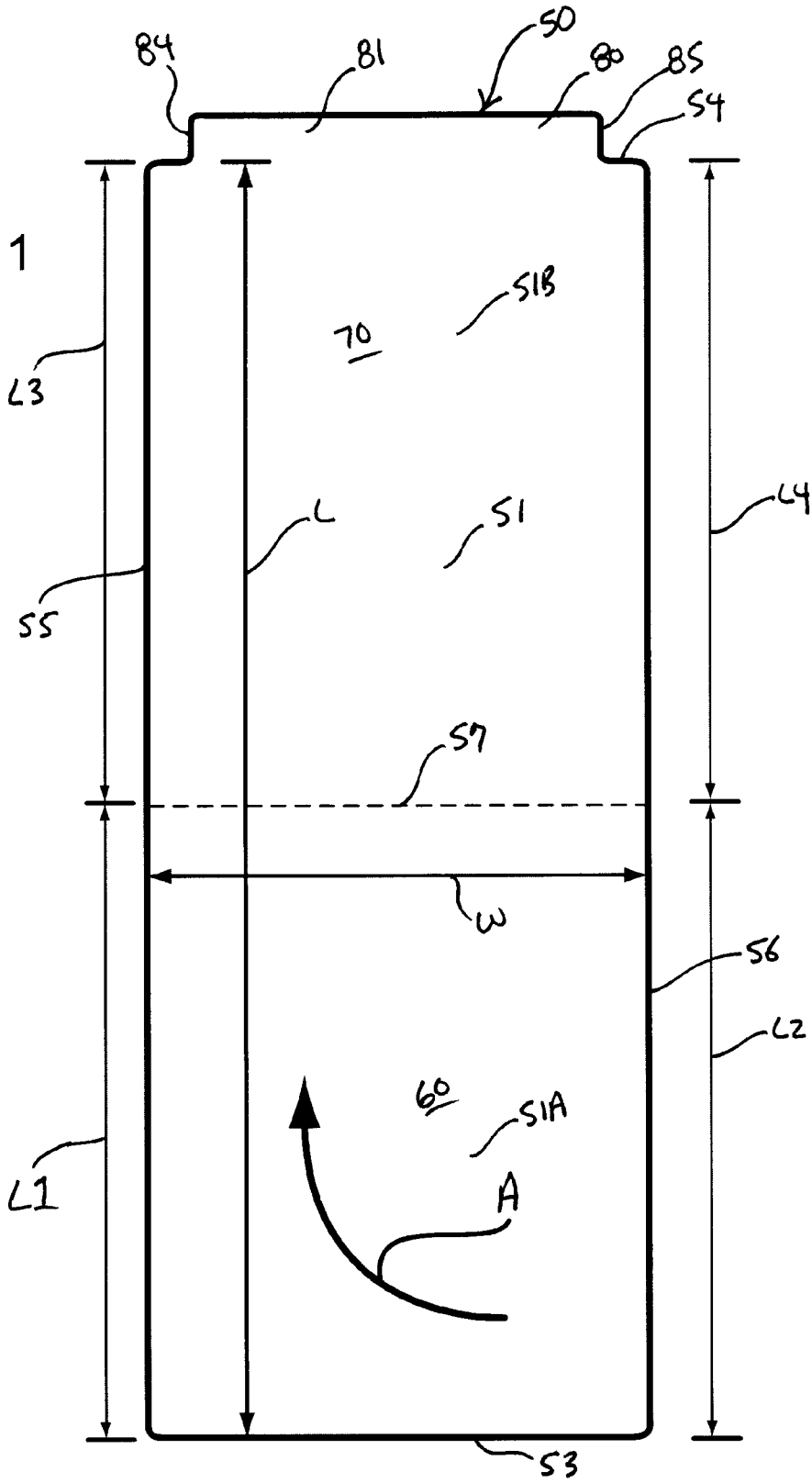
FIG. 1 is a top plan view of a sheet of pliant, flexible material used to manufacture a weight bag according to the principle of the invention.
Figure 2:
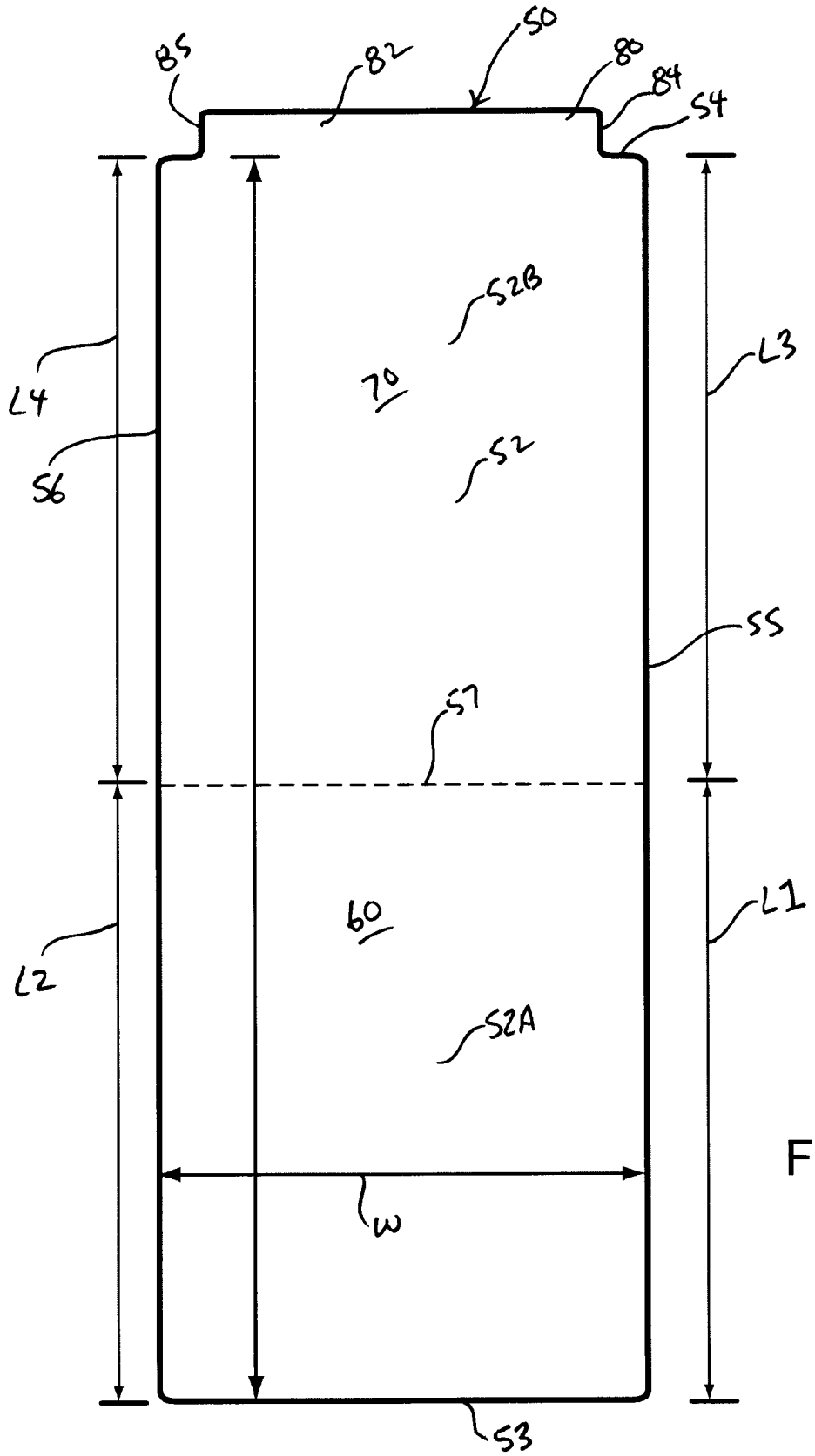
FIG. 2 is a bottom plan view of the sheet of FIG. 1.
Figure 3:
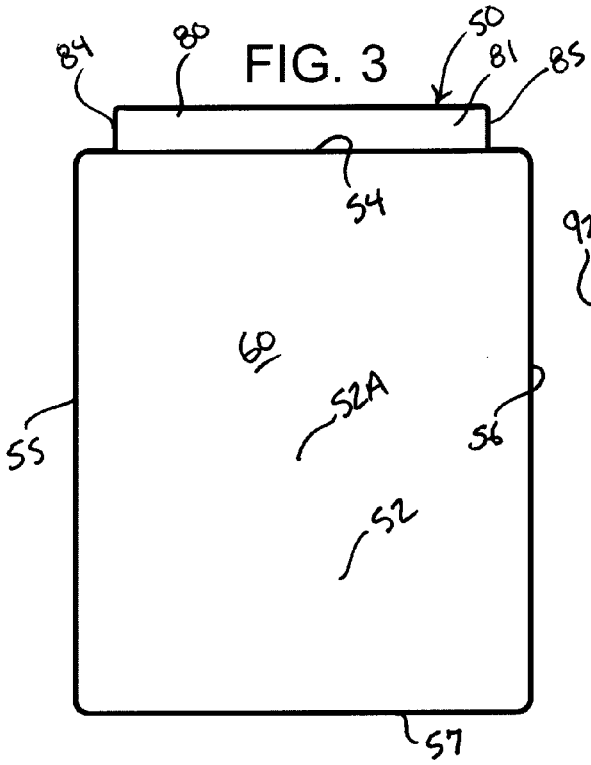
FIGS. 3-6 illustrate steps of forming hems in the sheet of FIGS. 1 and 2 to form an unfinished bag as shown in FIG. 6.

Turning now to the drawings, in which like reference characters indicate corresponding elements throughout the several views, attention is first directed to FIGS. 1 and 2 illustrating top and bottom plan views, respectively of a sheet 50 of material used to make a bag for receiving, holding, and containing a mass of granular material to form a weighted bag for use with a handled bag to form an exercise apparatus useful for resistance training purposes. Sheet 50 is an elongate and substantially rectangular in shape, and is flexible and pliant and preferably formed of tightly woven fabric, such as canvas, tightly woven nylon, or other or other strong, rugged, flexible and pliant fabric or fabric-like material or combination of materials. Referencing FIGS. 1 and 2 in relevant part, sheet 50 has opposed first and second major faces 51 and 52, opposed, substantially parallel first and second end marginal edges 53 and 54, opposed, substantially parallel first and second side marginal edges 55 and 56 extending between first and second end marginal edges 53 and 54, and an intermediate section denoted generally at 57 between the opposed first and second end marginal edges 53 and 54 extending across sheet 50 from first side marginal edge 55 to second side marginal edge 56 defining opposed, substantially coextensive first and second sections 60 and 70 of sheet 50 on either side of intermediate section 57. Sheet 50 has a width W extending between first and second side marginal edges 55 and 56, and a length L extending between first and second end marginal edges 53 and 54.

First section 60 of sheet 50 extends from intermediate section 57 to first end marginal edge 53, and first section includes a first length L1 of first side marginal edge 55 extending from intermediate section 57 to first end marginal edge 53, a first length L2 of second side marginal edge 56 extending from intermediate section 57 to first end marginal edge 53, a first portion 51A of first major face 51 extending between intermediate section 57 and first end marginal edge 53 and between first lengths L1 and L2 of first and second side marginal edges 55 and 56, respectively, and a first portion 52A of second major face 52 extending between intermediate section 57 and first end marginal edge 53 and between first lengths L1 and L2 of first and second side marginal edges 55 and 56, respectively. Second section 70 of sheet 50 extends from intermediate section 57 to second end marginal edge 54, and second section 70 includes a second length L3 of first side marginal edge 55 extending from intermediate section 57 to second end marginal edge 54, a second length L4 of second side marginal edge 56 extending from intermediate section 57 to second end marginal edge 54, a second portion 51B of first major face 51 extending between intermediate section 57 and second end marginal edge 54 and between second lengths L3 and L4 of first and second side marginal edges 55 and 56, respectively, and a second portion 52B of second major face 52 extending between intermediate section 57 and second end marginal edge 54 and between second lengths L3 and L4 of first and second side marginal edges 55 and 56, respectively. A flap 80 is attached to and projects outward from second end marginal edge 54 of second section 70 of sheet 50. Flap 80 has opposed first and second surfaces 81 and 82. First surface 81 is contiguous with the first major face 51, and second surface 82 is contiguous with second major face 52. Flap 80 is an extension of sheet 50, and flap 80 extends along substantially the entire width W of sheet 50 from a first extremity 84 of flap 80 located inboard of first end marginal edge 53, and a second extremity 85 of flap 80 located inboard of second end marginal edge 54. Sheet 50 is used to form an unfinished bag, according to the principle of the invention.

Forming an unfinished bag with sheet 50 according to the principle of the invention includes a series of method steps, including folding sheet 50 at intermediate section 57 over and upon itself in the direction indicated by the arcuate arrowed line A in FIG. 1 to form a fold in intermediate section 57 of sheet 50, which extends across width W of sheet 50 from first side marginal edge 55 to second side marginal edge 56, and folding first section 60 of sheet 50 over and atop second section 70 superimposing first section 60 of sheet 50 over and atop second section 70 of sheet 50 laying first section 60 of sheet 50 over and atop second section 70 of sheet 50 applying first portion 51A of first major face 51 over second portion 51B of first major face 51, applying first length L1 of first side marginal edge 55 of first section 60 atop and along second length L3 of first side marginal edge 55 of second section 70, applying first length L2 of second side marginal edge 56 of first section 55 atop and along second length L4 of second side marginal edge 56 of second section 70, and applying first end marginal edge 53 of sheet 50 atop and along second end marginal edge 54 of sheet 50 such that flap 80 projects outward, and is exposed with respect to, the first and second end marginal edges 53 and 54. The method next includes forming opposed hems in sheet 50 to form opposed closed sides in sheet 50, which hems are denoted generally at 90 and 100 in FIG. 6. Hem 90 is formed between lengths L1 and L3 and fastens length L1 to length L3, and hem 100 is formed between lengths L2 and L4 and fastens length L2 to length L4. The method of forming hems 90 and 100, and the resulting structures of hems 90 and 100, are identical. According hem 90 will be discussed in detail in connection with FIGS. 7-10, with the understanding that such details of hem 90 apply equally to Hem 100.

Figure 4:
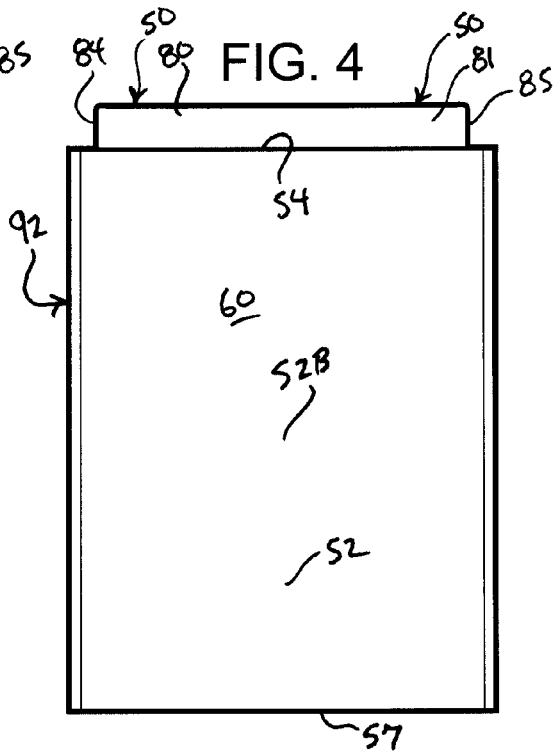
Figure 5:
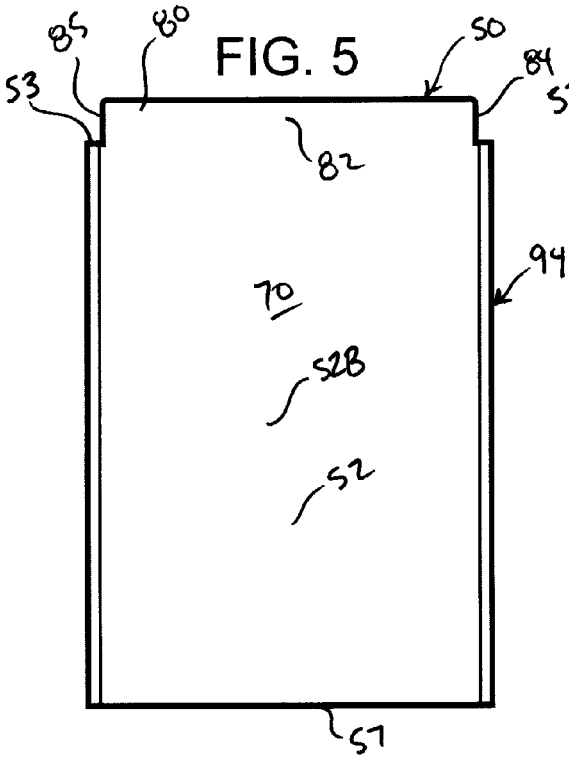
Figure 6:
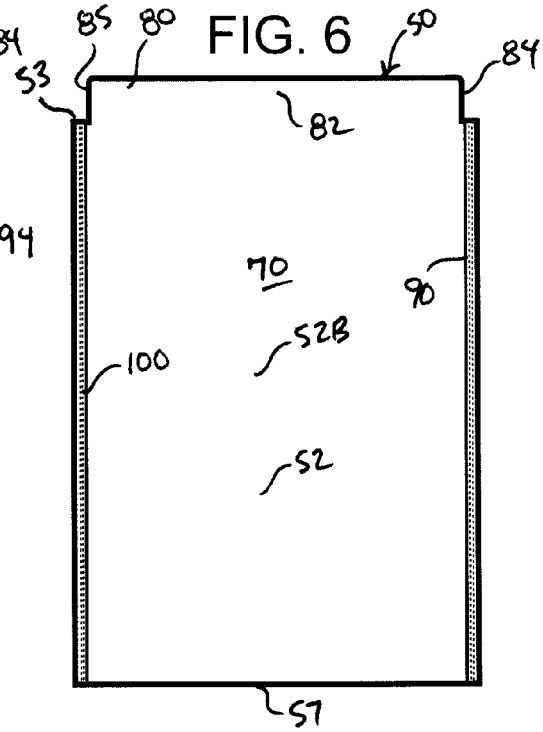
Figure 9:
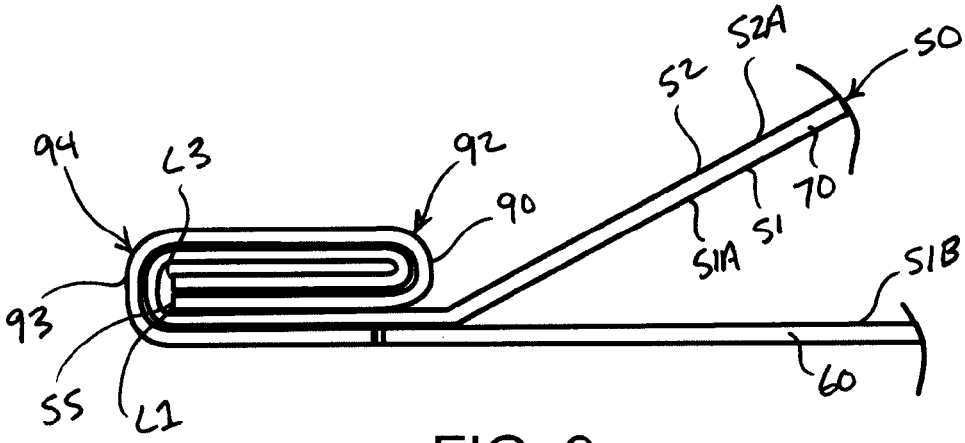
FIGS. 7-10 illustrate steps of forming a hem in the sheet of FIGS. 1 and 2.
Figure 8:
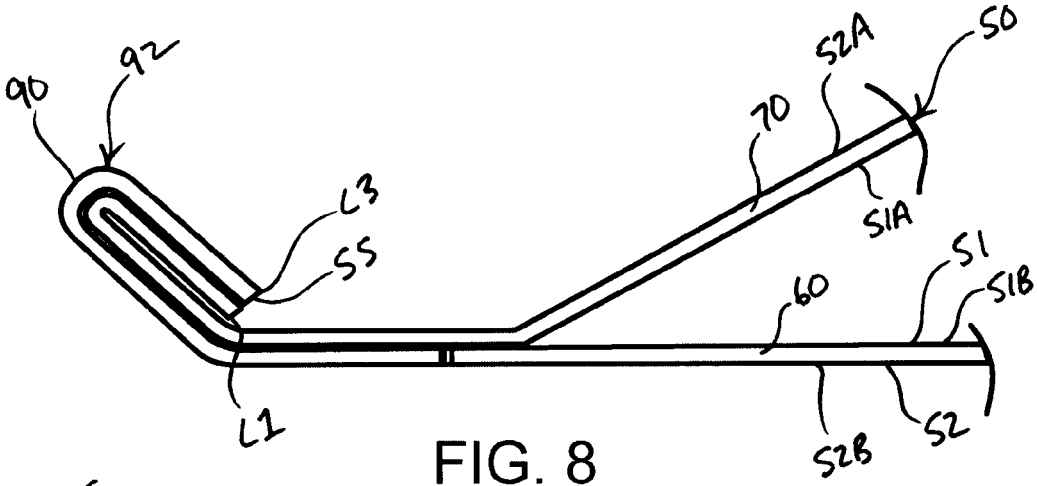
Figure 7:
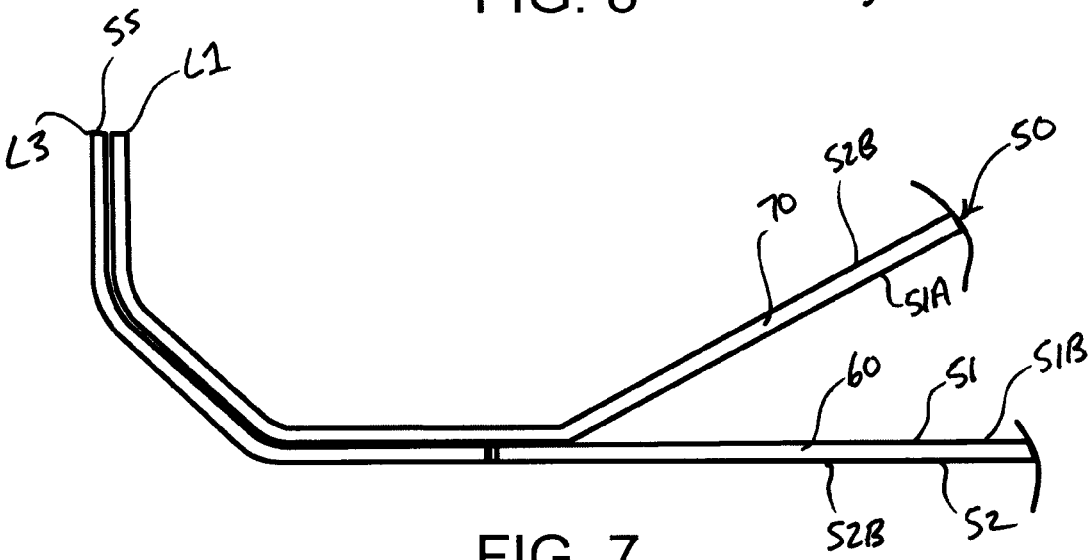
Figure 10:
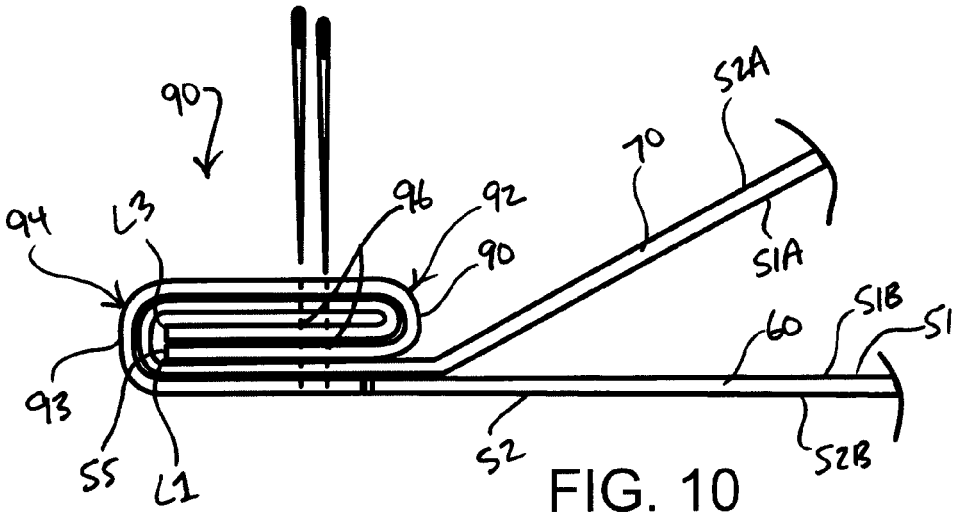

FIG. 7 illustrates first section 60 of sheet 50 applied atop second section 70 of sheet 50 as discussed above, such that first portion 51A of first major face 51 opposes and faces second portion 51B of first major face 51, and first length L1 of first side marginal edge 55 is applied atop and extends along second length L2 of first side marginal edge 55. The method of forming hem 90 includes, as shown in FIG. 8, folding back first end second lengths L1 and L3 of first side marginal edge 55 of first and second sections 60 and 70 of sheet 50 at a fold 91 onto second portion 52B of second major face 52 of sheet 50 forming a folded marginal extremity 92 in first and second lengths L1 and L3 extending from intermediate section 57 of sheet 50 to first and second end marginal edges 53 and 53 as shown in FIG. 4, and then folding back folded marginal extremity 92 onto second portion 52B of second major face 52 of sheet 50 at a fold 93 forming a double folded marginal extremity 94 in first and second lengths L1 and L3 extending from intermediate section 57 of sheet 50 to first and second end marginal edges 53 and 53 as shown in FIG. 5. Double folded marginal extremity 94 extends somewhat outboard of first extremity 84 of flap 80. After forming double folded marginal extremity 94, the method next includes sewing down double folded marginal extremity 94 with stitches 96 denoted in FIG. 10 along the entire length of extremity 94 from intermediate section 57 of sheet 50 to first and second end marginal edges 53 and 54 as shown in FIG. 6, thereby completing the formation of hem 90. Hem 90 is a multiple folded hem consisting of two folded extremities cooperating for form hem 90, and a hem similarly formed with more than two folded extremities can be carried out to form hem 90 if so desired. Again, hem 100 is formed in precisely the same way as hem 90, and the forgoing discussion of hem 90 applies in every respect to hem 100. Completion of hems 90 and 100 forms an unfinished bag as seen in FIG. 6. In unfinished bag 110, second major face 52 of sheet 50 forms an outer surface of unfinished bag 110, first major face 51 (FIG. 10) of sheet 50 forms an inner surface of unfinished bag 110 shown in FIG. 6 which bounds an chamber, and first and second end marginal edges 53 and 54 between hems 90 and 100 form an open mouth.

Figure 11:
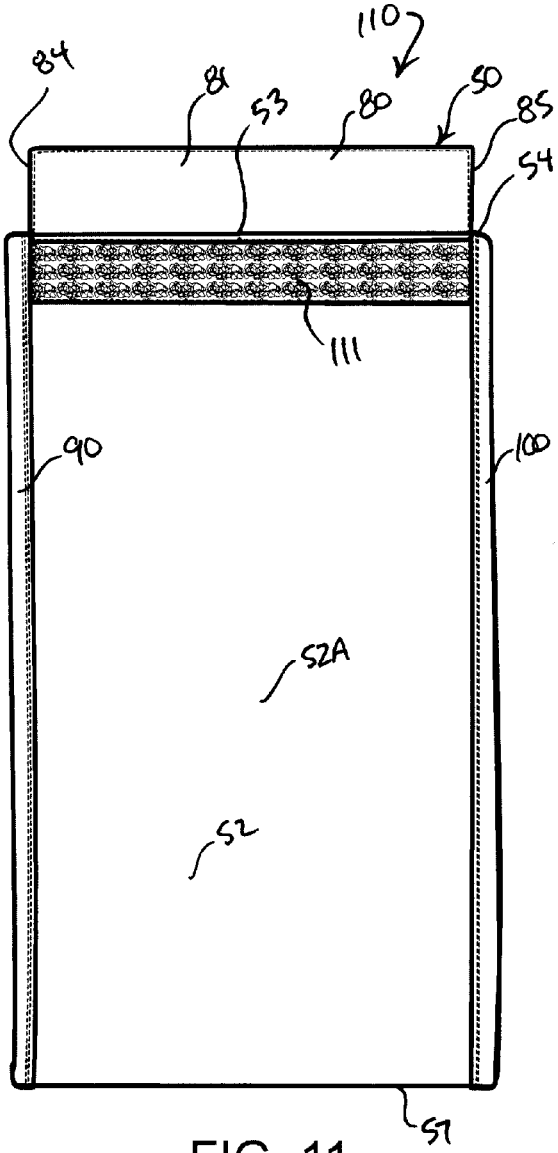
FIG. 11 is a top plan view of the unfinished bag of FIG. 6 shown as it would appear with a first element of a hook and loop fastening system applied thereto.
Figure 12:
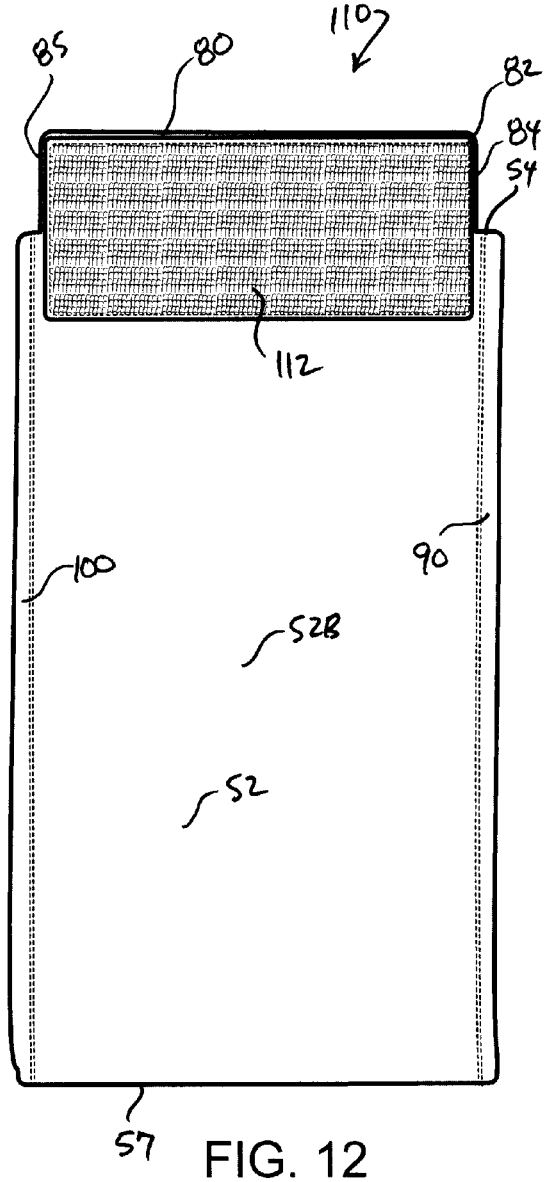
FIG. 12 is a bottom plan view of the embodiment of FIG. 11 shown as it would appear with a complemental element of the hook and loop fastening system applied thereto.

At this point in the manufacturing process, the beginning steps of application of a hook and loop fastening system are carried out, which, as seen in FIG. 11, involves applying a loop component 111 across first portion 52A of second major face 52 of first section 60 of sheet 50 at first end marginal edge 53 extending from hem 90 to hem 100. Loop component 111 is a long, broad rectangular layer consisting of a piece of fabric, covered with tiny hooks, which is affixed in place by sewing, glue, or the like. Application of the hook and loop fastening system according to the principle of the invention next includes, as seen in FIG. 12, applying a hook component 112 across second surface 82 of flap 80 and second portion 52B of second major face 52 of second section 70 of sheet 50 at and across second end marginal edge 54 extending from hem 90 to hem 100. Hook component 112 is considerably larger than loop component 111, and is a long, broad rectangular layer consisting of a piece of fabric, covered with tiny loops, which is affixed in place by sewing, glue, or the like. The loop and hook components 111 and 112 are exemplary of a hook-and-loop fastener commonly found under the VELCRO trademark.

Figure 16:
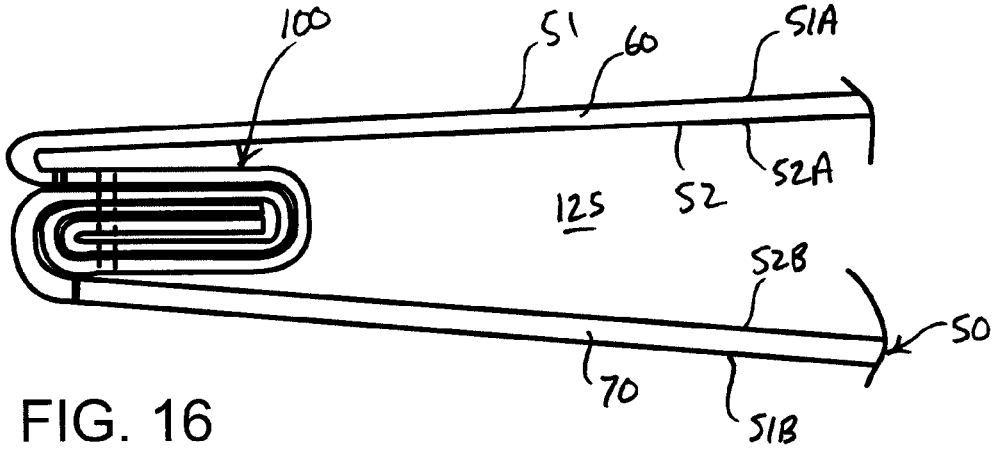
FIG. 16 is a section view taken along line 16-16 of FIG. 13.
Figures 13, 14, 15:
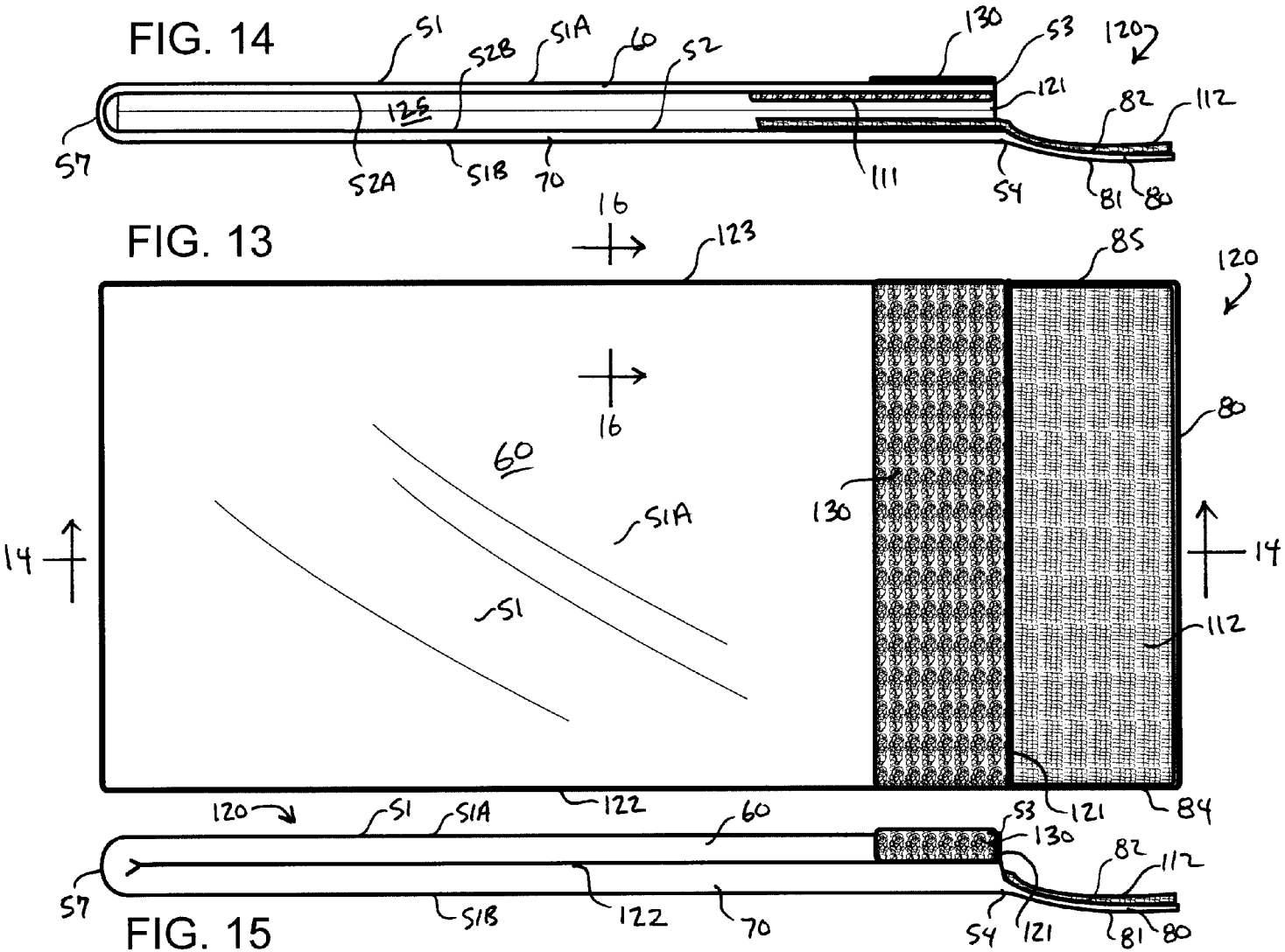
FIG. 13 is a view of the embodiment of FIGS. 11 and 12 shown as it would appear turned inside out forming a finished bag, and further shown as it would appear with a second element of the hook and loop fastening system applied thereto.
FIG. 14 is a section view taken along line 14-14 of FIG. 13.
FIG. 15 is a side elevation view of the embodiment of FIG. 13.

Having formed unfinished bag 110 as shown in FIGS. 11 and 12, the method next includes turning unfinished bag 110 inside out, just exactly like turning a sock inside out, to initially form a finished bag 120 shown in FIGS. 13-15 having, as best seen in FIG. 14, an outer surface formed by first major face 51 of sheet 50, an inner surface formed by second major face 52 of sheet 50, a closed end formed by intermediate section 57, an opposed mouth 121 formed by and between first and second end marginal edges 53 and 54 of first and second sections 60 and 70 extending between the opposed first and second hems 90 and 100 (not shown in FIG. 14), and opposed closed sides 122 and 123 shown in FIG. 13 formed by hems 90 and 100 (not shown in FIG. 13) extending between the closed end of finished bag 120 at intermediate section 57 and mouth 121 of finished bag 120, and a bag chamber 125 formed by and between the closed end formed by intermediate section 57 and mouth 121, the opposed closed sides formed by hems 90 and 100, and opposed, confronting first and second portions 52A and 52B of second major face 52. In finished bag 120, hems 90 and 100 are inverted and extend into the bag chamber 125, as shown in FIG. 16 illustrating hem 100 inverted into bag chamber 125 forming one of the closed sides of finished bag 120. Although not shown, hem 90 is similarly inverted into bag chamber 125. In finished bag 120, as seen in FIG. 13, flap 80 extends across mouth 121 from first extremity 84 of flap at hem 90 (not shown in FIG. 13) forming closed side 122 of finished bag 120 to second extremity 85 of flap 80 at hem 100 (not shown in FIG. 13) forming closed side 123 of finished bag 120, and, as shown in FIG. 14, loop component 111 of the hook and loop fastening system applied across second major face 52 of first section 60 of sheet 50 at first end marginal edge 53 extends from hem 90 to hem 100 as previously discussed that define the opposed closed sides 122 and 123 of finished bag 120 and opposes and confronts hook component 112 applied across second major face 52 of second section 70 of sheet 50 at second end marginal edge 54, which extends from hem 90 to hem 100 as previously discussed that define the opposed closed sides 122 and 123 of finished bag 120, according to the principle of the invention.

To complete finished bag 120 with referencing FIGS. 13 and 14 in relevant part, applying the hook and loop fastening system to sheet 50 is completed by applying another loop component 130 across first major face 51 of first section 60 of sheet 50 at first end marginal edge 53 extending from hem 90 to hem 100 defining the opposed closed sides 122 and 123 of finished bag 120. Loop component 130 is a long, broad rectangular layer consisting of a piece of fabric, covered with tiny hooks, which is affixed in place by sewing, glue, or the like. Having completed finished bag 120, it is now ready for use in accepting and holding a mass of granular material and may be referred to a weight bag.

Figure 20:
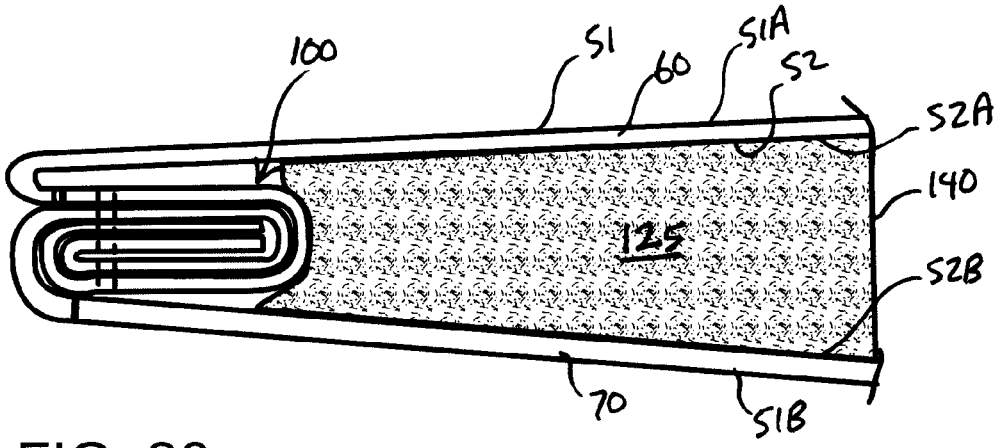
FIG. 20 is a section view taken along line 20-20 of FIG. 19.
Figures 18, 19, 21:
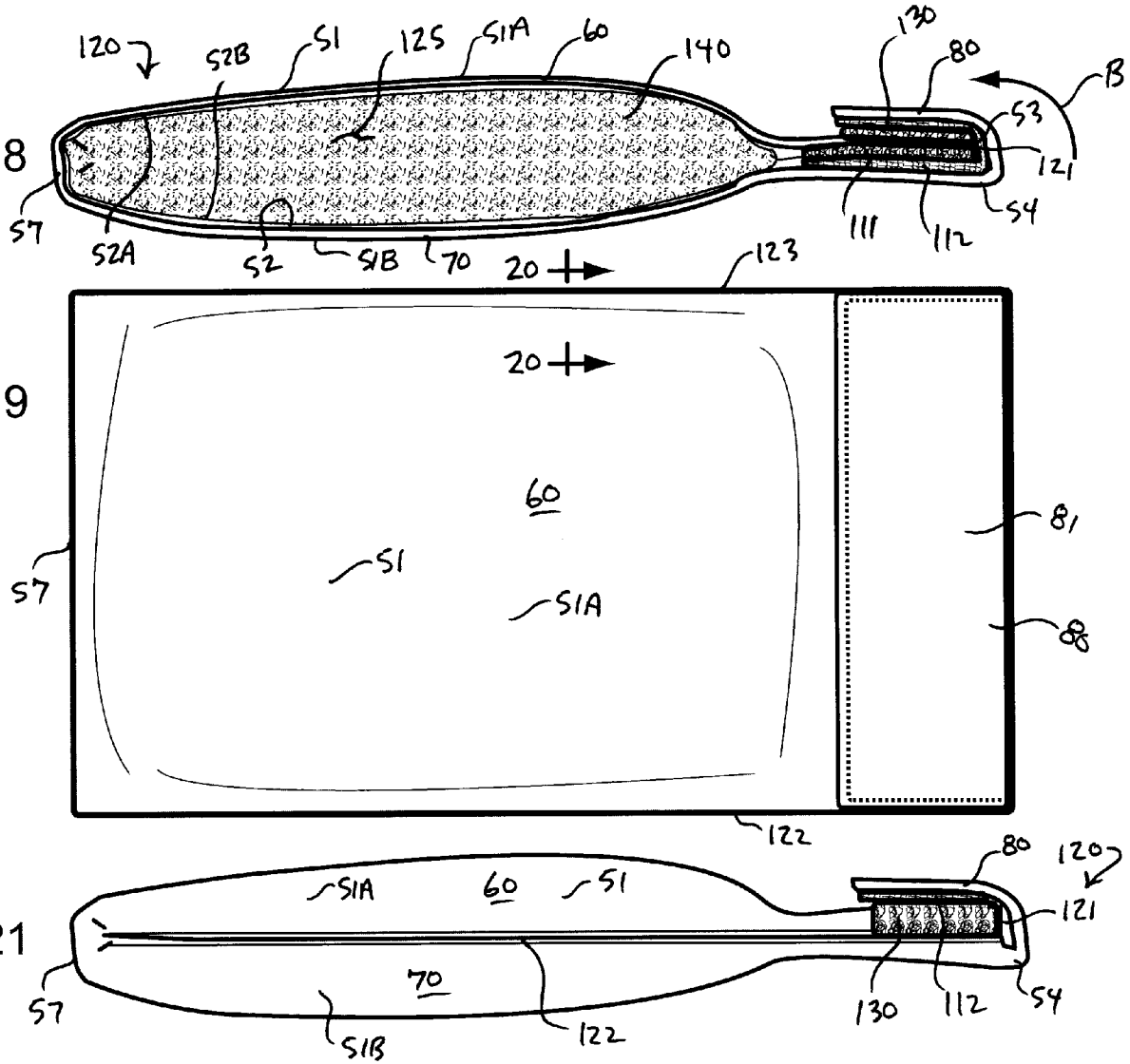
FIG. 18 is a section view of the finished bag of FIGS. 13-15 shown as it would appear filled with a mass of granular material and further shown as it would appear closed sealing the mass of granular material therein.
FIG. 19 is a top plan view of the embodiment shown in FIG. 18.
FIG. 21 is a side elevation view of the embodiment shown in FIG. 19.

FIG. 17 illustrates bag 120 a mass 140 of granular material, such as sand, metal beads, or the like, being poured from a container 141 into bag chamber 125 (not shown in FIG. 17) through open mouth 121 to fill bag chamber 125 with mass 140 as shown in FIG. 18, after which mouth 121 is closed and sealed. Mass 140 has a weight. By applying mass 140 to bag 120, the weight of mass 140 is imparted to bag 120 to form a weighted bag, namely, a bag weighted down with the weight of mass 140. To close and seal mouth 121, in accordance with the principle of the invention, involves applying loop component 111 of the hook and loop fastening system applied across second major face 52 of first section 60 of sheet 50 at first end marginal edge 53 against hook component 112 of the hook and loop fastening system applied across second major face 52 of second section 70 of sheet 50 at second end marginal edge 54 to initially close mouth 121 across the entire width of mouth 121 of bag 120 from and between hems 90 and 100 forming the opposed closed sides 122 and 123 of bag 120 to form a primary seal of mouth 121, folding flap 80 over mouth 121 as closed and across first end marginal edge 53 the closed mouth 121 in the direction generally indicated by arcuate arrowed line B toward loop component 130 and first portion 51A of first major face 51 to register hook component 112 of the hook and loop fastening system applied across second surface 82 of flap 80 with loop component 130 of the hook and loop fastening system, and then applying hook component 112 carried by flap 80 against loop component 130 thereby securing flap 80 to first portion 51A of first major face 51 of sheet forming a secondary closure and seal of mouth 121. This closure of mouth 121, the structure of hems 90 and 100, and the inverted orientation of hems 90 and 100 into bag chamber 125 forms a secure and reliable containment of mass 140 in bag 120 and prevents mass 140 from leaking from bag 120 through mouth 121 and closed sides 122 and 123, according to the principle of the invention. FIG. 20 is a view very similar to that of FIG. 16 illustrating hem 100 inverted into bag chamber 125 forming one of the closed sides of finished bag 120 and the application of mass 140 in bag chamber 125 and the relationship of mass 140 with respect to hem 100. Although not shown, hem 90 is similarly inverted into bag chamber 125 and relates to mass 140 filling bag chamber 125 in the same manner as hem 100. Mass 140 of granular material has a weight, and with mass 140 so applied to bag 120 substantially filling bag 125 as discussed and bag closed and sealed as further discussed and as shown in FIGS. 18, 19, 20, and 22, bag 120 is weighted down with mass 140 and is ready to be used for resistance training purposes.

Figure 23:
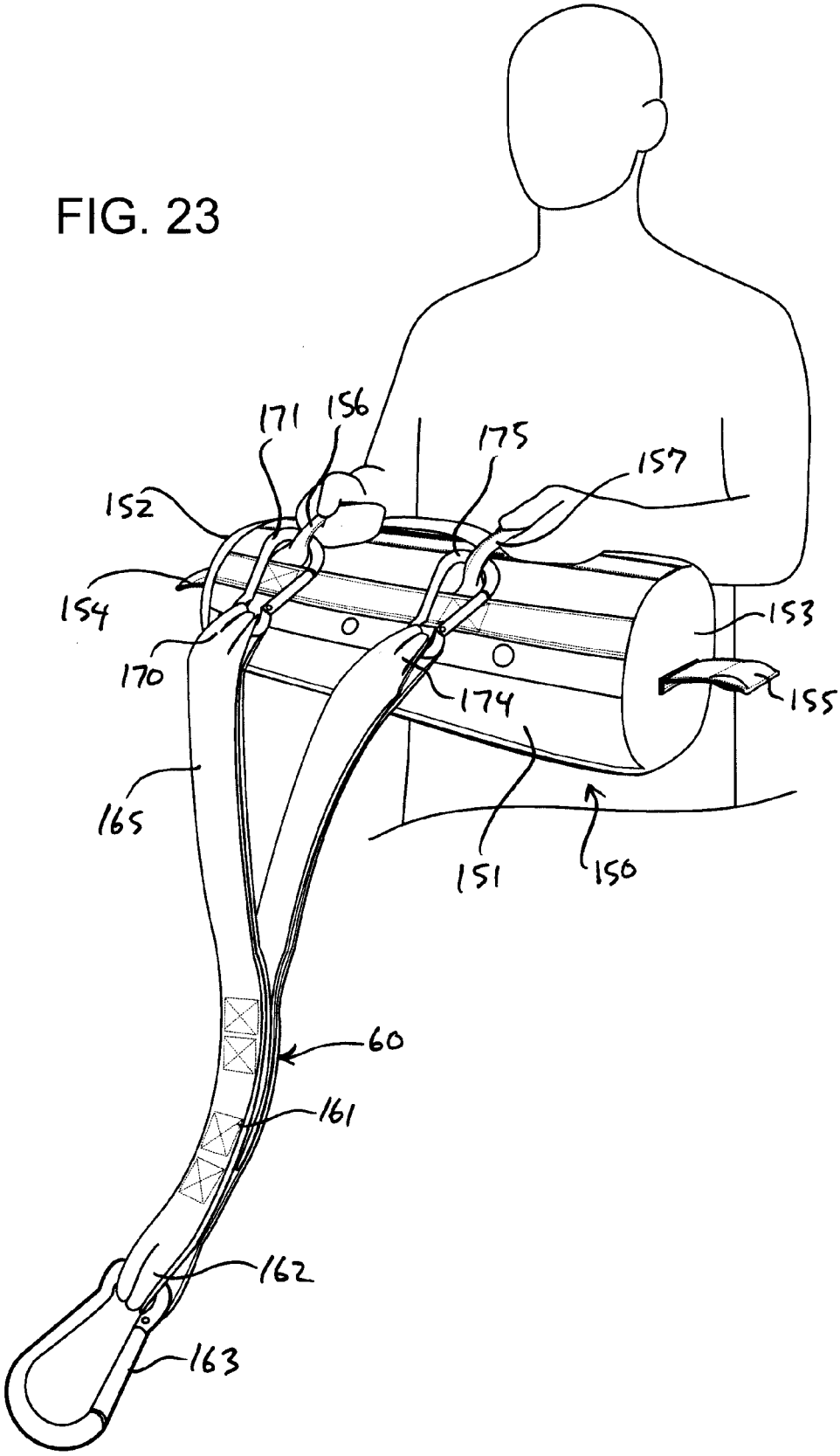
FIG. 23 is a perspective view of the handled bag of FIG. 22 shown as it would appear in use and with attached strapping.

Weighted bag 120 is used in connection with a handled bag 150 as shown in FIG. 22. Handled bag 150 in FIG. 22 is formed principally of a canvass, nylon, or other flexible, strong fabric or fabric-like material or combination of materials, and includes a continuous sidewall 151 having opposed closed ends 152 and 153 formed with handles 154 and 155, respectively. Sidewall 151 is formed with opposed, parallel handle straps 156 and 157, and is severed between closed ends 152 and 153 forming an opening 158 into bag 150. Bag 120 is inserted into bag 150 through opening 158, and opening 158 is then closed with a closure assembly formed with bag 150, such as a zipper closure assembly, snap closure assembly, or the like. At this point, bag 150 is weighted down with the weight of mass 140 applied to and carried by bag 120 and together form a weight or resistance training exercise apparatus, in which bag 150 may be taken up, such as by hand at handles 154 and 155, or handles 157 and 158 as shown in FIG. 23, and lifted in any number of lifting exercises to provide resistance training. Because mass 140 of granular material is not a solid mass and shifts and flows, it shifts and moves during the lifting of bag 150 and thus provides an imbalanced weight that shifts and flows, which targets muscles groups not commonly targeted in conventional weight training. Bag 120 can be formed of any size to as to assume the desired weight when filled or partially filled with a mass of granular material having a weight, such as a mass of sand in the preferred embodiment.

Figure 24:
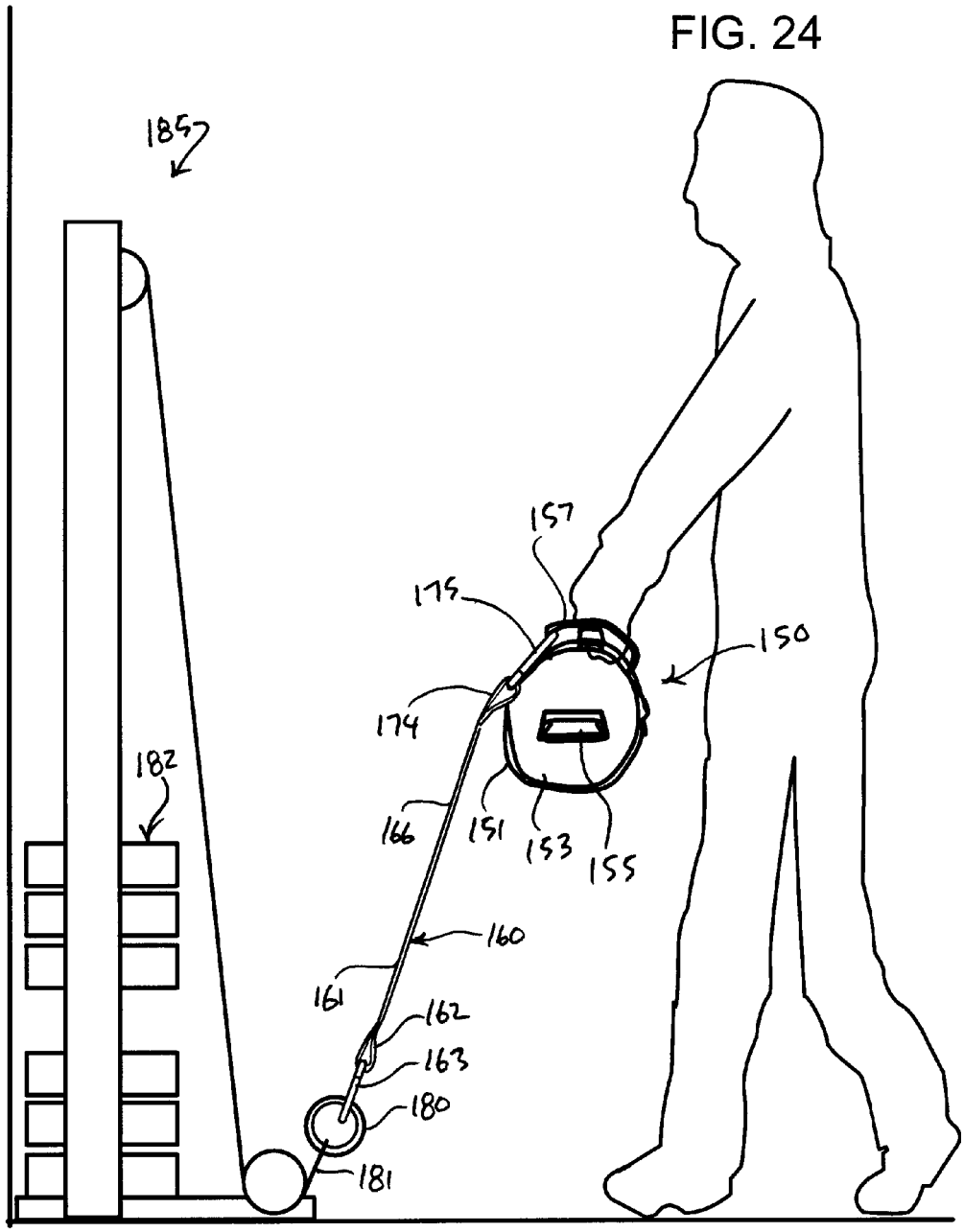
FIG. 24 is a side elevation view of the embodiment of FIG. 23 illustrating the strapping coupled between the handled bag and a weight stack of a weight machine.

To increase the usefulness of bag 150 loaded down with weighted bag 120, bag 150 may be coupled to a weight for lifting in addition to the weight provided by the weight imparted by bag 120 weighted down with a mass of granular material. FIG. 23 illustrates strapping 160, which is formed of nylon, canvass, or the like. Strapping 160 is an assembly of straps that form a main strap branch 161 having an end 162 looped through a carabiner 163, and opposed branch straps 165 and 166. Branch strap 165 has an end 170 looped through a carabiner 171, and strap 166 has an end 174 looped through a carabiner 175. In FIG. 23, strap 156 of bag 150 is looped through carabiner 171, and strap 157 of bag 150 is looped through carabiner 175 coupling bag 150 to strapping 160 forming an alternate embodiment of bag 150. At this point, carabiner 163 may be coupled to a weight to be lifted concurrently with the lifting of bag 150 as shown in FIG. 24, which illustrates carabiner 163 coupled to a ring element 180 secured to the end of a cable 181 operatively coupled to a weight 182 of a weight machine 185. In this arrangement, the user may repeatedly lift bag 150 to lift the weight of weight 182 and also the weight of bag 150, in accordance with the principle of the invention. In the present embodiment, the weight coupled to bag 150 via strapping 160 is formed with a weight machine, and the weight can be a free weight or other weight as may be desired.

The invention has been described above with reference to a preferred embodiment. However, those skilled in the art will recognize that changes and modifications may be made to the embodiment without departing from the nature and scope of the invention. For instance, the positioning of the hook and loop components of the hook and loop fastening system can be switched as may be desired without departing from the invention. Also, although in the formation of the unfinished bag the hems 90 and 100 are formed over or across second portion 52B of second major face 52, hems 90 and 100 can be similar formed over or across first portion 52A of second major face without departing from the invention. If desired, one hem can be formed over or across second portion 52B of second major face 52, and the other hem can be formed over or across first portion 52A of second major face 52. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A method of manufacturing an exercise apparatus incorporating imbalanced weight, the method comprising steps of:

providing an elongate, substantially rectangular sheet of flexible, pliant material having opposed first and second major faces, opposed, substantially parallel first and second end marginal edges, opposed, substantially parallel first and second side marginal edges extending between the first and second end marginal edges, and an intermediate section between the opposed first and second end marginal edges extending across the sheet from the first side marginal edge to the second side marginal edge defining opposed, substantially coextensive first and second sections of the sheet on either side of the intermediate section;

the sheet having a width extending between the first and second side marginal edges, and a length extending between the first and second end marginal edges;

the first section of the sheet extending from the intermediate section to the first end marginal edge, and the first section including a first length of the first side marginal edge extending from the intermediate section to the first end marginal edge, a first length of the second side marginal edge extending from the intermediate section to the first end marginal edge, a first portion of the first major face extending between the intermediate section and the first end marginal edge and between the first lengths of the first and second side marginal edges, respectively, and a first portion of the second major face extending between the intermediate section and the first end marginal edge and between the first lengths of the first and second side marginal edges, respectively;

the second section of the sheet extending from the intermediate section to the second end marginal edge, and the second section including a second length of the first side marginal edge extending from the intermediate section to the second end marginal edge, a second length of the second side marginal edge extending from the intermediate section to the second end marginal edge, a second portion of the first major face extending between the intermediate section and the second end marginal edge and between the second lengths of the first and second side marginal edges, respectively, and a second portion of the second major face extending between the intermediate section and the second end marginal edge and between the second lengths of the first and second side marginal edges, respectively;

a flap attached to and projecting outward from the second end marginal edge of the second section of the sheet, the flap having a first surface contiguous with the first major face, an opposed second surface contiguous with the second major face, and the flap extends along substantially the entire width of the sheet from a first extremity of the flap located inboard of the first end marginal edge and a second extremity of the flap located inboard of the second end marginal edge;

forming an unfinished bag by:

folding the sheet at the intermediate section to form a fold in the intermediate section and applying the first section of the sheet over and atop the second section of the sheet applying the first portion of the first major face over the second portion of the first major face, applying the first length of the first side marginal edge of the first section atop and along the second length of the first side marginal edge of the second section, applying the first length of the second side marginal edge of the first section atop and along the second length of the second side marginal edge of the second section, and applying the first end marginal edge of the sheet atop and along the second end marginal edge of the sheet such that the flap projects outward and is exposed with respect to the first and second end marginal edges;

forming a first hem in the sheet by folding back the first end second lengths of the first side marginal edge of the first and second sections of the sheet onto the second major face of the sheet forming a first folded marginal extremity extending from the intermediate section of the sheet to the first and second end marginal edges, folding back the first folded marginal extremity onto the second major face of the sheet forming a first double folded marginal extremity extending from the intermediate section of the sheet to the first and second end marginal edges, and sewing down the first double folded marginal extremity from the intermediate section of the sheet to the first and second end marginal edges; and forming a second hem in the sheet by folding back the first and second lengths of the second side marginal edge of the first and second sections of the sheet onto the second major face of the sheet forming a second folded marginal extremity extending from the intermediate section of the sheet to the first and second end marginal edges, folding back the second folded marginal extremity onto the second major face of the sheet forming a second double folded marginal extremity extending from the intermediate section of the sheet to the first and second end marginal edges, and sewing down the second double folded marginal extremity from the intermediate section of the sheet to the first and second end marginal edges thereby forming an unfinished bag;

the second major face of the sheet comprising an outer surface of the unfinished bag and the first major face of the sheet comprising an inner surface of the unfinished bag;

applying a hook and loop fastening system to the sheet including a first element thereof applied across the second major face of the first section of the sheet at the first end marginal edge extending from the first hem to the second hem, and a complemental element thereof applied across the second surface of the flap and the second major face of the second section of the sheet at the second end marginal edge extending from the first hem to the second hem;

turning the unfinished bag inside out to form a finished bag having an outer surface formed by the first major face of the sheet, an inner surface formed by the second major face of the sheet, a closed end formed by the intermediate section and an opposed mouth formed by and between the first and second end marginal edges of the first and second sections extending between the opposed first and second hems, opposed closed sides formed by the first and second hems extending between the closed end of the bag at the intermediate section and the mouth of the bag, and a bag chamber formed by and between the closed end formed by the intermediate section, the opposed closed sides, the mouth, and the first portion of the second major face confronting the second portion of the second major face, in which the first and second hems are inverted in the finished bag extending into the bag chamber, the flap extends across the mouth from the first extremity of the flap at the first hem to the second extremity of the flap at the second hem, and the first element of the hook and loop fastening system applied across the second major face of the first section of the sheet at the first end marginal edge extends from the first hem to the second hem and opposes and confronts the complemental element of the hook and loop fastening system applied across the second major face of the second section of the sheet at the second end marginal edge, which extends from the first hem to the second hem;

wherein the step of applying a hook and loop fastening system to the sheet further includes applying a second element across the first major face of the first section of the sheet at the first end marginal edge extending from the first hem to the second hem;

wherein the first and second elements of the hook and loop fastening system are each one of a hook portion and a loop portion of the hook and loop fastening system, and the complemental element of the hook and loop fastening system is the other of the hook portion and the loop portion of the hook and loop fastening system;

providing an imbalanced weight consisting of a mass of granular material;

applying the mass of granular material to the bag chamber through the mouth;

sealing the mouth of the finished bag to form an imbalanced weighted bag component by applying the first element of the hook and loop fastening system applied across the second major face of the first section of the sheet at the first end marginal edge against the complemental element of the hook and loop fastening system applied across the second major face of the second section of the sheet at the second end marginal edge forming primary seal of the mouth, folding the flap over the mouth and the second element of the hook and loop fastening system applied to the first portion of the first surface of the first section of the sheet registering the complemental element of the hook and loop fastening system applied across the second surface of the flap with the second element of the hook and loop fastening system, and applying the complemental elemental element of the hook and loop fastening system against the second element of the hook and loop fastening system securing the flap forming a secondary seal of the mouth;

providing a handled bag; and applying the imbalanced weighted bag component to the handled bag.

2. A method according to claim 1, further comprising coupling the handled bag to a weight.

3. A method according to claim 2, wherein the step of coupling the handled bag to a weight further comprises providing an elongate, pliant strapping and coupling the strapping between the weight and the handled bag.

* * * * *